US006584637B1

(12) United States Patent
Witter

(10) Patent No.: US 6,584,637 B1
(45) Date of Patent: Jul. 1, 2003

(54) GROUT SEALER APPLICATOR

(76) Inventor: Lowell F. Witter, 450 S. Belmont, Elgin, IL (US) 60123

( * ) Notice: Subject to any disclaimer, the term of this patent is extended or adjusted under 35 U.S.C. 154(b) by 42 days.

(21) Appl. No.: 09/707,175

(22) Filed: Nov. 6, 2000

(51) Int. Cl.[7] ..... A46B 5/04; B05C 17/00
(52) U.S. Cl. ..... 15/160; 15/227; 15/244.1
(58) Field of Search ..... 15/104.94, 227, 15/160, 244.1; 401/6–8; 2/21; D4/103

(56) References Cited

U.S. PATENT DOCUMENTS

| | | | | | |
|---|---|---|---|---|---|
| 628,185 | A | | 4/1899 | Richards | 15/188 |
| 1,168,998 | A | | 1/1916 | Brandenburg | 15/167.1 |
| 1,200,596 | A | * | 10/1916 | Daly | 15/227 |
| 1,230,683 | A | * | 6/1917 | Daly | 15/227 |
| 1,795,500 | A | * | 3/1931 | Omundson | 401/7 X |
| 2,077,540 | A | | 4/1937 | Welker | 401/7 |
| 2,112,184 | A | | 3/1938 | Vogan | 601/139 |
| 2,167,129 | A | * | 7/1939 | Sleeper | 15/227 X |
| 2,389,237 | A | * | 11/1945 | Petrullo | 2/21 X |
| 2,621,356 | A | * | 12/1952 | Ingraham | 401/7 |
| 2,735,127 | A | * | 2/1956 | Parsons | 15/227 |
| 3,226,754 | A | * | 1/1966 | Brittain | 15/227 X |
| 3,943,592 | A | * | 3/1976 | Bhaskar et al. | 15/160 |
| D251,516 | S | | 4/1979 | Guedel | D4/103 |
| 4,177,698 | A | * | 12/1979 | Greneker | 401/7 X |
| 4,251,897 | A | * | 2/1981 | Alam | 15/227 X |
| 4,602,650 | A | | 7/1986 | Pipkin | 132/317 |
| D290,426 | S | | 6/1987 | Courney | D4/103 |
| D313,317 | S | | 1/1991 | Brunner et al. | D4/103 |
| 5,026,541 | A | * | 6/1991 | Lanier | 15/227 X |
| 5,045,073 | A | | 9/1991 | Wagner | 604/310 |
| 5,213,428 | A | | 5/1993 | Salman | 401/7 |
| 5,287,584 | A | * | 2/1994 | Skinner | 15/227 X |
| 5,348,153 | A | | 9/1994 | Cole | 206/361 |
| 5,502,863 | A | | 4/1996 | Perkins | 15/227 |
| 5,875,513 | A | | 3/1999 | Reinold | 15/227 |
| 5,909,739 | A | | 6/1999 | Masrour-Rad | 132/308 |
| 6,016,571 | A | * | 1/2000 | Guzman et al. | 15/227 X |

FOREIGN PATENT DOCUMENTS

| | | | | |
|---|---|---|---|---|
| FR | 575672 | * | 8/1924 | 15/227 |
| GB | 398919 | * | 9/1933 | 15/227 |
| GB | 2043438 | * | 10/1980 | 15/227 |
| GB | 2136681 | * | 9/1984 | 15/227 |

* cited by examiner

*Primary Examiner*—Mark Spisich
(74) *Attorney, Agent, or Firm*—Brinks Hofer Gilson & Lione

(57) ABSTRACT

A grout sealer applicator increases efficiency in applying sealer to grout. A strip or patch of material for releasably holding sealer is adapted to be held on a finger. For example, the material is bonded to a rubber or plastic sleeve. As another example, the material forms a band around a finger.

15 Claims, 1 Drawing Sheet

GROUT SEALER APPLICATOR

BACKGROUND

The present invention relates generally to grout sealer applicators. After applying grout to tile, the grout is sealed to avoid mildew and staining. A liquid grout sealer is applied to the grout. Preferably, application of the grout sealer to the tile is minimized.

Various devices have been used for applying the grout sealer to the grout. For example, a sponge is soaked in the grout sealer and then slid along the grout. As another example, a wheel with bristles along the circumference of the wheel is dipped in the grout sealer and then run along the grout using a supporting handle. As yet another example, a piece of cloth fabric is wrapped around a finger. The finger and the material are dipped into the liquid grout sealer to absorb the sealer. The fabric is then slid along the grout.

SUMMARY

The present invention is defined by the following claims, and nothing in this section should be taken as a limitation on those claims. By way of introduction, the preferred embodiment described below includes a grout sealer applicator, a method of use of the applicator and a method of manufacture of the applicator.

In one aspect, a strip of material for releasably holding grout sealer, such as a strip of bristles or sponge material is applied around a sleeve. Alternatively, a patch adapted to fit around a tip of a finger is applied on the sleeve. The sleeve is adapted for fitting over an appendage such as the finger of a user. For example, the sleeve comprises a flexible rubber material.

In a second aspect, a strip of material for releasably holding the grout sealer is adapted for use around an appendage without the sleeve. For example, a band of bristles is positionable around a finger.

The applicator is dipped within grout sealer. The sleeve may prevent sealer from getting on the user's finger. The grout sealer is then applied to the grout by sliding the bristles or sponge material along the grout.

The applicator with the sleeve is manufactured by applying a bonding agent to one or both of the strips of material and the sleeve. The strip of material is then bonded to the sleeve.

Further objects and attendant advantages are best understood by reference to the following detailed description in conjunction with the attached drawings.

DETAILED DESCRIPTION OF THE PRESENTLY PREFERRED EMBODIMENTS

Figure 1:
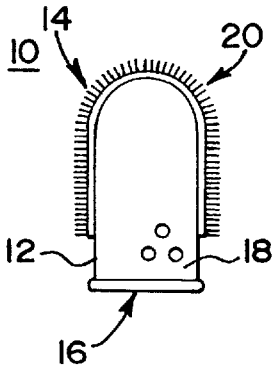
FIG. 1 is a side view of one embodiment of a grout sealer applicator.

A grout sealer is provided for efficiently sealing tile grout. Spillage of sealer on a person's hand is minimized by a sleeve of the applicator. A strip of material for releasably holding the sealer is provided on the sleeve. The width of the strip generally corresponds to the width of the grout, so spillage of the sealer on the tile is minimized.

FIGS. 1–4 show a grout sealer applicator at 10. The applicator 10 comprises a sleeve 12 and material 14 for releasably holding a liquid grout sealer.

The sleeve 12 comprises a rubber, plastic, fiberglass, metal, wood, combinations thereof or other material shaped to fit over an appendage. For example, a flexible rubber material is shaped to fit over a tip of a finger. The sleeve 12 has an aperture 16 for insertion of the appendage, such as the finger, within the sleeve 12. The tip portion 20 is rounded, such as being generally similar to the shape of the tip of a finger. In other embodiments, corners or edges are provided. For example, interior portion 22 of the sleeve 12 is rounded or cylindrical in shape but an outer portion is cubic or box like. The sleeve 12 generally encloses the appendage during use, but may be provided with other apertures, such as to form a band.

One or more pressure apertures 18 are provided for releasing air as an appendage is inserted within the sleeve 12. In one embodiment, the pressure apertures 18 are closer to the appendage aperture 16 than a tip portion 20 of the sleeve 12.

In one embodiment, the interior portion 22 is textured. For example, a plurality of knobs, ridges, indentations or other texture structures are provided. The texture provides comfort as well as maintaining the sleeve 12 in position over the appendage.

The material 14 releasably holds liquid grout sealer. For example, the material 14 comprises open cell sponge material. The open cell sponge material comprises natural or synthetically made sponge material. As another example, bristles, such as a paint pad or a paintbrush bristles, are provided. The bristles comprise loop or cut loop fiber structures. Any of various lengths of bristle material may be used, such as ⅛ inch bristles. In one embodiment, the bristles are mounted to a fabric, plastic or other backing material. In other embodiments, the bristles are manufactured onto the sleeve 12 without additional backing material.

In one embodiment, the material 14 comprises a strip of material. The strip of material has a width that is about ½ of a diameter of the sleeve 12 where the sleeve 12 is adapted for use on a finger. The width is 1/16, ⅛, ¼ of an inch or another dimension. The width may correspond to common grout widths. The strip of material 14 is of various lengths. For example, a two to three inch length is provided. Shorter or longer lengths may be used.

Figure 2:
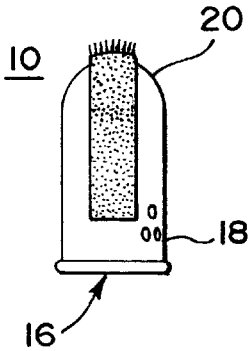
FIG. 2 is a side view of the applicator of FIG. 1 rotated 90 degrees.
Figure 3:
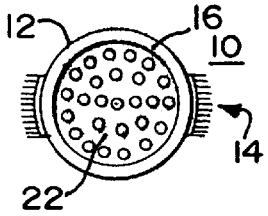
FIG. 3 is a bottom view of the applicator of FIG. 1.
Figure 4:
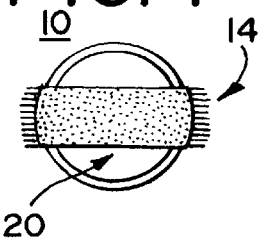
FIG. 4 is a top view of the applicator of FIG. 1.

The strip of material 14 is positioned on the sleeve. The material 14 is placed on one side of the sleeve 12, around the tip portion 20, to an opposite side of the sleeve 12 as shown in FIGS. 1 and 2. Various portions of the material are then used for applying the sealer to grout as a function of the angle of the finger to the grout. The rounded portion over the tip portion allows for more even wear of various locations along the material 14.

Figure 8:
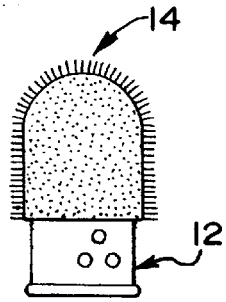
FIG. 8 is a side view of another embodiment of a grout sealer applicator.

Other positions of the material 14 relative to the sleeve 12 may be used, such as positioning the material 12 around the circumference of the sleeve 12 (i.e. horizontally positioned as opposed to the vertical positioning shown in FIG. 1). The material 14 may be provided just at the tip portion 20, just on a side of the sleeve 12, or as separate strips of material at different positions on the sleeve 12. For example, FIG. 8 shows the material 14 shaped like the end of the sleeve 12 or the tip of a finger. The material 14 covers the circumference of an upper side portion and the tip portion 20.

Figure 5:
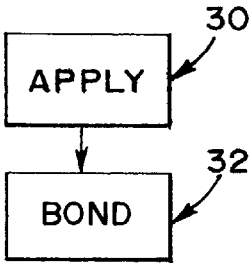
FIG. 5 is a flow chart diagram representing one embodiment of a method for manufacturing a grout sealer applicator.

FIG. 5 shows a flow chart diagram of a method for manufacturing the applicator 10. A bonding agent is applied to one of the sleeve 12 or the material 14 in act 30. The material 14 is then bonded to the sleeve 12 in act 32.

The bonding agent is applied in act 30 to the portion of the sleeve 12 that comes in contact with the material 14. A subset of these portions of the sleeve 12 may be used. For applying the bonding agent to the material 14, the bonding agent is applied to the backing or one side of the strip of material 14.

The bonding agent comprises an epoxy, glue, or other adhesive material. In alternative embodiments, a snap, Velcro, shaped mating surfaces or other mechanisms for attaching the material 14 to the sleeve 12 are provided.

In act 32, the material 14 is placed on the sleeve 12. The bonding agent is cured.

Figure 6:
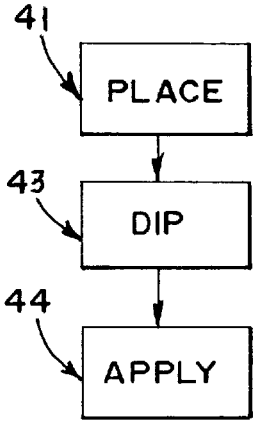
FIG. 6 is a flow chart diagram of one embodiment of a method for using a grout sealer applicator.

FIG. 6 shows a flow chart diagram representing the application of sealer to grout with the applicator 10. In act 41, the applicator 10 is placed over an appendage. The applicator 10 is dipped in the liquid grout sealer in act 43. In act 44, the sealer is applied from the applicator 10 to the grout.

Figure 7:
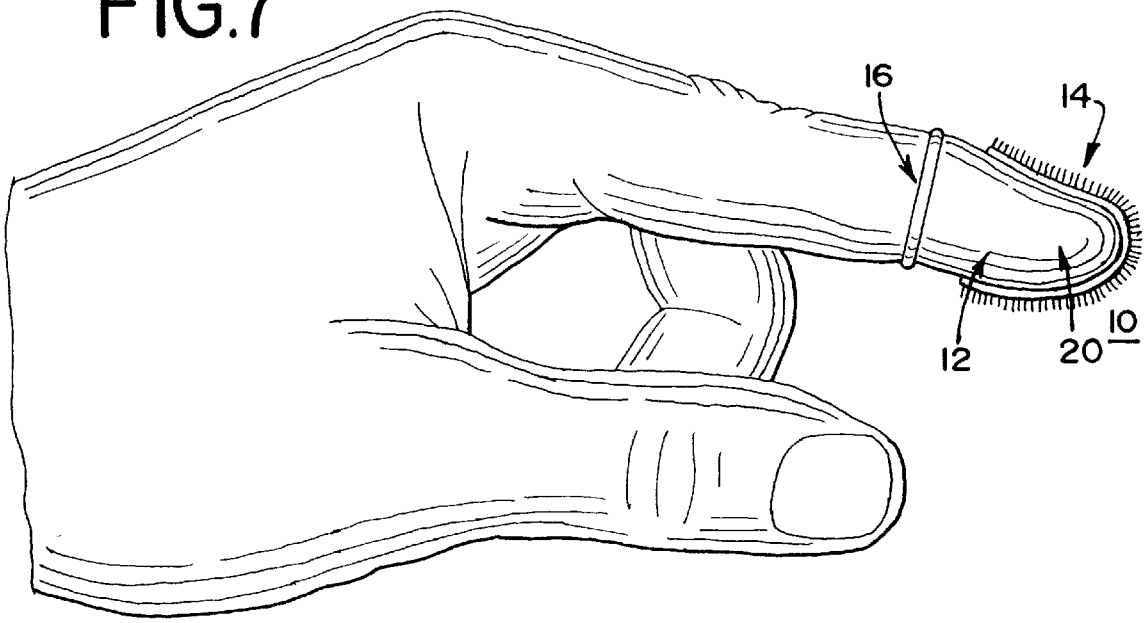
FIG. 7 is a graphical representation of the applicator of FIG. 1 in use on the hand of a user.

In act 41, the applicator 10 is placed over a finger, such as shown in FIG. 7. The material 14 is positioned on a pad or bottom side of the finger opposite the fingernail. Other positions of the material 14 relative to the finger may be used. As material near the tip portion 20 and on the bottom side of the finger wears, the sleeve 12 is rotated so that the non-worn material 14 is The applicator 10 is dipped within the liquid grout sealer so that a portion of or the entire material 14 is within the liquid sealer. A portion of the sleeve 12, including any pressure apertures 18, are maintained above the liquid sealer so that the liquid sealer is not spilled onto the finger. Alternatively, sealer is allowed to contact the appendage.

As the applicator 10 is withdrawn from the liquid sealer, the material 14 releasably holds some grout sealer. In act 44, the material 14 is placed on the grout. Preferably, the strip of material 14 is in a parallel position with respect to the grout to avoid application of sealer on the tile. Alternatively, some material 14 is allowed to contact the tile. The applicator 10 is slid along the grout. The applicator 10 and finger may be rotated as pressure is applied to release additional sealer onto the grout. Alternatively, the top side of the material 14 is placed on the grout. The hand is moved, sliding the material 14 along the grout in a first direction. The finger is then turned over and different portions of the material 14 is applied over the same area of grout. The material 14 at the end of the applicator 10 may place sealer along patio doors or other corners. Thus, the top, bottom and end of the applicator 10 may be used each time the applicator 10 is dipped into the liquid grout sealer. A moist sponge may be run along the grout and tile to absorb any excess sealer.

Figure 9A:
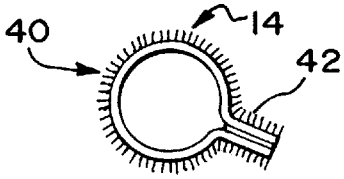
FIGS. 9A and 9B are top and side views, respectively, of yet another embodiment of a grout sealer applicator without a sleeve.
Figure 9B:
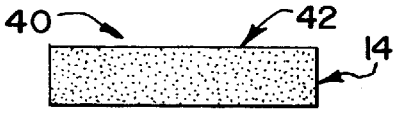

FIGS. 9A and 9B show an alternative embodiment without a sleeve 12. A strip of material 14 with a backing is formed in a band or ring 40. The band 40 is sized to fit around one or more fingers. The backing comprises bristle backing (e.g., fabric or plastic) or a more rigid material, such as metal or hard plastic. The band 40 may form a complete loop or have an opening for sizing.

In one embodiment, the band 40 is bonded in an overlapping or seamed manner to avoid any extensions. Alternatively, an extension 42 as shown is provided. The ends of a strip of the material 14 are bound together to form the band 40 and extension 42. In other embodiments, an added extension 42 or handle is used to maintain the band 40 in a comfortable position around the appendage. In yet other embodiments, a patch of material 14 formed to cover a tip of an appendage is used without a sleeve.

A wide range of changes and modifications can be made to the preferred embodiment described above. For example, different materials 14 with more or less coverage of the sleeve 12 or appendage may be used. As another example, the sleeve 12 may only partially cover the appendage, such as a mesh sleeve or framework sleeve. Thus, it is intended that the foregoing detailed description be regarded as illustrative rather than limiting.

It is the following claims, including all equivalents, which are intended to define the scope of this invention.

I claim:

1. A tool for applying sealer to grout, the tool comprising:

a flexible rubber sleeve including an aperture adapted to receive an appendage, the sleeve including a closed end at a tip portion thereof and an open end for receiving the appendage;

a material for releasably holding liquid grout sealer, the material being one of open cell sponge material and bristles, the material continuously covering the tip portion of the sleeve as well as the entire circumference thereof from the tip portion to a point adjacent to but spaced from the open end of the sleeve; and a plurality of pressure release apertures in the sleeve region thereof between the grout applying material and the open end thereof, the portion of the sleeve covered by said material being entirely free of any such apertures.

2. The tool of claim 1 wherein the sleeve comprises a knobbed textured surface on an interior portion.

3. A tool for applying sealer to grout, the tool comprising:

a sleeve including an aperture adapted to receive a fingertip, the sleeve including a closed end at a tip portion thereof and an open end for receiving the fingertip; and a continuous strip of bristles extending from the sleeve along a substantial portion of a length of a first side of the sleeve, over the tip portion of the sleeve and along a substantial portion of a second side of the sleeve opposite the first side, the material extending a generally equal extent on the first and second sides, the strip of bristles having a substantially constant width, third and fourth opposite sides of the sleeve between said first and second sides being free of bristles.

4. The tool of claim 3 wherein the sleeve comprises a flexible rubber sleeve.

5. The tool of claim 3 wherein the sleeve comprises at least one pressure release aperture positioned closer to the aperture adapted to receive the fingertip than the tip portion of the sleeve, the tip portion and a portion of the sleeve between the aperture and the tip portion free of additional apertures.

6. The tool of claim 3 wherein the sleeve comprises a textured surface on an interior portion.

7. The tool of claim 3 wherein the strip comprises a width about half a diameter of the sleeve.

8. A tool for applying sealer to grout, the tool comprising:

a flexible rubber sleeve including an aperture adapted to receive an appendage, the sleeve including a closed end at a tip portion thereof and an open end for receiving the appendage;

a continuous strip of material operable to releasably hold liquid grout sealer, the material being one of open cell sponge material and bristles, the material extending along a substantial portion of a length of a first side of the sleeve, over the tip portion of the sleeve and a substantial portion of a second side of the sleeve opposite the first side, the material extending a generally equal extent on the first and second sides, the strip of material having a substantially constant width, and third and fourth opposite sides of the sleeve between the first and second sides being free of said material.

9. The tool of claim 8 wherein the sleeve comprises a textured surface on an interior portion.

10. The tool of claim 8 wherein the material covers the entire tip portion.

11. A tool for applying sealer to grout, the tool comprising:

a band of material having open ends and which defines an aperture between said ends for receiving an appendage;

bristles extending from at least half the circumference of the band; and an extension extending between said ends and along the length of the band, the extension extending radially outward from the periphery of the band.

12. The tool of claim 11 wherein the band comprises a complete loop.

13. The tool of claim 11 wherein the band includes an opening.

14. The tool of claim 11 wherein the band comprises a width of about ¼ inch.

15. The tool of claim 11 wherein the bristles extend from an entire circumference of the band.

* * * * *